US008776646B2

(12) United States Patent
Chervenak et al.

(10) Patent No.: US 8,776,646 B2
(45) Date of Patent: Jul. 15, 2014

(54) LOCKING PLIERS

(75) Inventors: Thomas M. Chervenak, Stanley, NC (US); David P. Engvall, Stanley, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 594 days.

(21) Appl. No.: 13/026,738

(22) Filed: Feb. 14, 2011

(65) Prior Publication Data

US 2011/0203421 A1 Aug. 25, 2011

Related U.S. Application Data

(60) Provisional application No. 61/307,136, filed on Feb. 23, 2010.

(51) Int. Cl.
*B25B 7/16* (2006.01)

(52) U.S. Cl.
USPC ..... 81/367; 81/324

(58) Field of Classification Search
USPC ..... 81/367, 318–324, 357, 368
See application file for complete search history.

(56) References Cited

U.S. PATENT DOCUMENTS

| | | | | |
|---|---|---|---|---|
| 1,094,536 | A * | 4/1914 | Davis | 81/322 |
| 2,313,270 | A | 3/1943 | Sapp | |
| 2,652,832 | A * | 9/1953 | Castrobiejo | 81/322 |
| 3,859,874 | A | 1/1975 | Joeckel | |
| 4,144,737 | A * | 3/1979 | Izraeli | 72/409.11 |
| 4,787,279 | A * | 11/1988 | Undin | 81/323 |
| 5,233,893 | A * | 8/1993 | Schmidt | 81/368 |
| 6,164,107 | A | 12/2000 | Korba, Jr. | |
| 6,276,651 | B1 | 8/2001 | Dolan | |
| 6,450,070 | B1 * | 9/2002 | Winkler et al. | 81/367 |
| 8,024,998 | B1 * | 9/2011 | Valencia | 81/368 |

FOREIGN PATENT DOCUMENTS

| | | |
|---|---|---|
| NZ | 5761168 | 4/2009 |
| WO | 2007028111 A2 | 3/2007 |

OTHER PUBLICATIONS

Intellectual Property Office, United Kingdom Patent Application No. GB1102966.7, Search and Examination Report, Mar. 30, 2012.

* cited by examiner

*Primary Examiner* — Hadi Shakeri
(74) *Attorney, Agent, or Firm* — Dennis J. Williamson; Moore & Van Allen PLLC

(57) ABSTRACT

A locking tool is provided that comprises an adjustment mechanism that can adjust the distance between the jaws, and the clamping force exerted by the jaws on a workpiece, using the same hand that grips the handles of the tool. A locking tool is also provided where the tool can be locked by moving the handles toward one another. Once locked, the pliers can be unlocked and the jaws opened by squeezing the handles toward one another in the same manner, in the same direction and using the same hand as was done to lock the pliers. As a result the pliers can be locked and unlocked using one-hand and using the same hand movement to both lock and unlock the pliers.

20 Claims, 22 Drawing Sheets

LOCKING PLIERS

This application claims benefit of priority under 35 U.S.C. §119(e) to the filing date of to U.S. Provisional Application No. 61/307,136, as filed on Feb. 23, 2010, which is incorporated herein by reference in its entirety.

BACKGROUND

Pliers-type hand tools with toggle-locking mechanisms are generally known as locking pliers. These pliers typically comprise a fixed arm having a fixed jaw on one end thereof. A movable arm pivots a movable jaw relative to the fixed jaw to open and close the jaws. The toggle-locking mechanism typically uses an over-center linkage to lock the jaws relative to one another. To grip a workpiece, the arms are tightly compressed such that the linkage of the toggle-locking mechanism locks the pliers onto the workpiece. Adjustments in the force applied by the jaws to the workpiece are generally made by turning an adjusting screw mounted in the fixed handle that engages the toggle locking mechanism. The adjusting screw is translated relative to the fixed handle to modify the physical dimensions of the toggle-locking mechanism to vary the effective length of the linkage of the toggle-locking mechanism. This adjustment varies the distance between the ends of the linkage to vary the distance between the jaws and the force applied by the jaws to the workpiece when the tool is locked. The pliers will remain firmly locked in place without the continuous application of force by the user. To open the pliers the user may pull the handles apart. Alternatively, the pliers may be provided with a release lever mounted on the movable handle that may be depressed to move the linkage out of the over-center locking position.

SUMMARY

A locking tool is provided that comprises an adjustment mechanism that can adjust the distance between the jaws, and the clamping force exerted by the jaws on a workpiece, using the same hand that grips the handles of the tool. The user then has free use of their other hand to, for example, hold the workpiece that is to be engaged by the jaws. A locking tool is also provided where the tool can be locked by moving the handles toward one another. Once locked, the pliers can be unlocked and the jaws opened by squeezing the handles toward one another in the same manner, in the same direction and using the same hand as was done to lock the pliers. As a result the pliers can be locked and unlocked using one-hand and using the same hand movement to both lock and unlock the pliers.

A locking tool such as a lockable pliers comprises a first arm supporting a first jaw. A second arm is movable relative to the first arm between an open position and a closed position. A second jaw is movable between a first position when the second arm is in the open position and a second position when the second arm is in the closed position. A locking mechanism locks the second jaw in the second position. A collar is adjustably mounted on an adjustment screw such that the collar moves when the adjustment screw is rotated to vary the force applied by the jaws. A first actuating mechanism and a second actuating mechanism for rotating the adjustment screw are provided such that the screw may be rotated by the same hand that holds the pliers.

The first actuating mechanism may comprise a head of the screw that extends from a distal end of the first arm. The second actuating mechanism may be located at a position spaced from the first mechanism along the length of the first arm. The second actuating mechanism may be rotatable. The first arm may have a first end and a second end and the second actuating mechanism may include an actuating member located between the first end and the second end. The second actuating mechanism may be located such that it can be manipulated by the fingers or thumb of a hand when the lockable pliers is gripped by that hand. The second actuating mechanism may extend through an aperture formed in the first arm. The pliers may further comprise a locking mechanism for locking the second jaw in the second position by a first movement of the second arm toward the first arm and unlocking the second jaw by a second movement of the second arm toward the first arm.

A lockable tool such as a locking pliers comprises a first arm supporting a first jaw. A second arm is movable relative to the first arm between a first position and a second position. A second jaw is movable between a locked position when the second arm is in the first position and an unlocked position when the second arm is in the second position. A locking mechanism locks the second jaw in the locked position by a first movement of the first arm toward the second arm and unlocks the second jaw by a second movement of the first arm toward the second arm.

The lockable tool may comprise a link having a first end connected to the second arm and a second end connected to a movable collar where the collar can move along the first arm. The link may comprise surfaces that cooperate with a catch mounted on the second arm that allow the pliers to be moved between the locked position and the unlocked position with one hand. The link may be formed with a first stop, a second stop and a third stop that engage the catch as the pliers are moved between the locked position and the unlocked position. The catch may be pivotably mounted on the second arm. A spring may bias the catch in a first direction. The catch may comprise a first lobe and a second lobe that engage the link. A safety may be provided for preventing the catch from rotating when the pliers are in the locked position. A second lobe on the catch may engage the first stop in an intermediate position. When the second arm is moved away from the first arm, the second lobe may be moved out of engagement with the first stop such that the first lobe engages a second stop to prevent the rotation of the link relative to the second arm. The first lobe may be disengaged from second stop during the second movement.

A method of operating a locking tool comprises providing a first arm and a second arm, the first arm and the second arm being movable relative to one another to move a first jaw relative to a second jaw, and a locking mechanism comprising a link; moving the first arm and the second arm toward one another to lock the jaws relative to one another and moving the first arm and the second arm toward one another to unlock the jaws. The method further comprises engaging a safety to prevent the jaws from unlocking.

DETAILED DESCRIPTION OF PREFERRED EMBODIMENTS OF THE INVENTION

Figure 6:
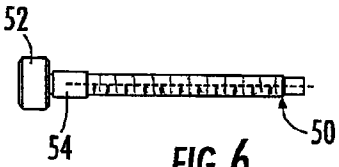
FIG. 6 is a side view of an adjustment screw used in the adjustment mechanism of FIG. 1.
Figure 8:
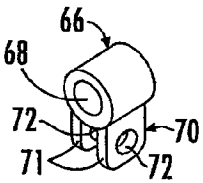
FIG. 8 is a perspective view of a yoke used in the adjustment mechanism of FIG. 1.
Figure 10:
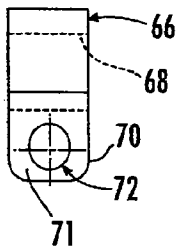
FIG. 10 is a side view of the yoke of FIG. 8.
Figure 7:
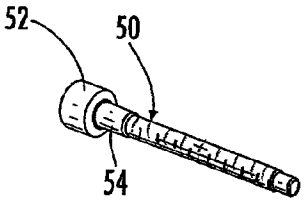
FIG. 7 is a perspective view of the adjustment screw of FIG. 6.
Figure 9:
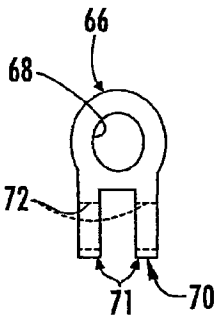
FIG. 9 is an end view of the yoke of FIG. 8.

The one-hand adjustment mechanism described herein may be used with any locking tools that use an adjustment screw to set the spacing between the jaws and the clamping force applied by the jaws to a work piece. The one-hand locking mechanism described herein may be used with any locking tools where locking of the jaws relative to one another is desired. The adjustment mechanism and locking mechanism are particularly suitable for use in the same locking tool although the locking mechanism and adjustment mechanism may be employed separately from one another. The jaws of the locking pliers may be shaped to function as standard pliers, long nose pliers, pliers with curved jaws, serrated jaws, C-clamps, C-clamps with swivel pads, hole punches, or any other kind of hand tool where the locking action is useful.

For purposes of explaining the construction and operation of the adjustment mechanism of the invention, one such locking pliers 10 will be described in detail with reference to FIGS. 1 through 10. Pliers 10 includes a fixed arm 11 forming a fixed handle 12 at one end and having a fixed jaw 13 at the other end. A movable arm 16 is pivotably connected to the movable jaw 17 by pivot pin 20. Movable arm 16 forms a movable handle 19 that is disposed opposite to fixed handle 12 such that a user may grip the handles 12, 19 in one hand to move the arms toward one another to close the jaws. A pivot pin 18 connects the movable jaw 17 to the fixed arm 11.

A locking mechanism comprises a link 22 that is pivotably connected between the movable arm 16 and fixed arm 11 to lock the arms and the jaws 13 and 17 relative to one another. One end of link 22 is pivotably connected to arm 16 at pivot 24. The opposite end of link 22 is pivotably connected to collar 66 by pivot pin 26. Collar 26 is threadably mounted on a screw 50 such that rotation of the screw 50 moves the collar 66 along the length of the screw. The collar 66 comprises a threaded bore 68 that is located on the screw 50 such that the external threads of screw 50 engage the internal threads of collar 66. As a result, as screw 50 is rotated, either by rotation of first actuating mechanism 52 or by rotation of second actuating mechanism 58, the collar 66 is moved in a straight line up and down the length of screw 50 and fixed arm 11. The collar 66 includes a yoke 70 that extends from the fixed arm 11 and into the space between the fixed arm 11 and the movable arm 16. Yoke 70 includes a pair of flanges 71 that define aligned bores 72 and are spaced to receive the end of linkage 22 therebetween. Bores 72 receive pin 26 that connects the collar 66 to the link 22 such that the link 22 can pivot relative to the collar 66.

The position of collar 66 and pivot pin 26 may be adjustably positioned along the length of fixed arm 11 to vary the spacing between the jaws and the force exerted by the jaws on a work piece when the locking mechanism is in the locked position. While a particular embodiment of the locking mechanism is shown it is to be understood that the linkage may have a variety of configurations including simple toggle-locking mechanisms, compound toggle-locking mechanisms and the one-hand locking mechanism described herein. A release lever 27 may be pivotably connected to arm 16 such that user may depress the end 27*b* of lever 27 to raise end 27*a* and move link 22 to unlock the locking mechanism.

Screw 50 is located in the fixed arm 11 such that the longitudinal axis of the screw is disposed along and located in the fixed arm 11. In one embodiment, in order to maintain the dimension of the fixed handle relatively similar to existing locking pliers a screw having a 5/16 inch diameter may be used. In one embodiment a thread pitch of about 14 threads per inch may be used to prevent the collar 66 from backdriving on the screw 50 and that requires a low turning force.

The screw 50 is formed with a first actuating mechanism such as an enlarged head 52 that can be manually rotated to adjust the locking pliers. A bearing surface 54 is formed adjacent the head 52 that is received in a through hole 56 formed in the fixed arm 11 such that the bearing surface 54 is supported by and can rotate relative to the fixed arm 11. The head 52 is positioned such that extends from the distal end of the arm 11 opposite to jaw 13. The opposite end of the screw 50 is connected to a second actuating mechanism 58. In one embodiment the actuating mechanism 58 comprises a rotary actuating member that is fixed to the screw 50 and extends through a cut-out or aperture 60 formed in the top of arm 11. The actuating mechanism 58 may be positioned between the two ends of the arm 11 between head 52 and jaw 13. The second actuating mechanism 58 is spaced from the first actuating mechanism 52 along the length of arm 11. The actuating mechanism 58 may be rotated by the thumb of the user to rotate screw 50 within fixed arm 11. In one embodiment the exterior diameter of actuating member 58 is 5/8 inch in order to provide relatively easy turning and to fit into the fixed arm 11. The actuating member of mechanism 58 may comprise a knurled cylindrical knob having a centrally located bore that receives and is connected to the end of screw 50. The actuating member 58 is mounted in the fixed arm 11 such that the actuating mechanism 58 may be rotated relative to the fixed arm 11 but is otherwise fixed to the arm. Rotation of the actuating mechanism 58 results in rotation of the screw 50 about its longitudinal axis. While the actuating mechanism 58 is shown as a rotary member connected directly to the screw, the actuating member may be connected to the screw via other elements such as a transmission comprising a gear train or the like. Further, the actuating member could move other than in a rotary motion provided that it is capable of rotating screw 50. Screw 50 does not translate relative to arm 11 along its longitudinal axis when it is rotated.

Figure 1:
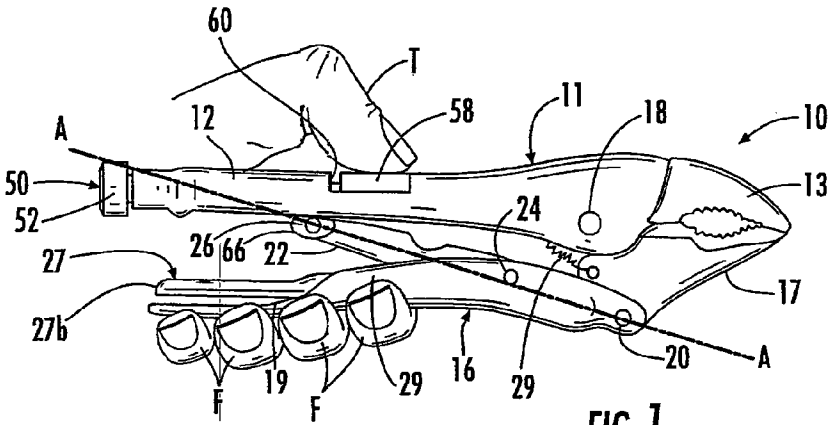
FIG. 1 is an embodiment of a locking pliers showing the one-hand adjustment mechanism.
Figure 2:
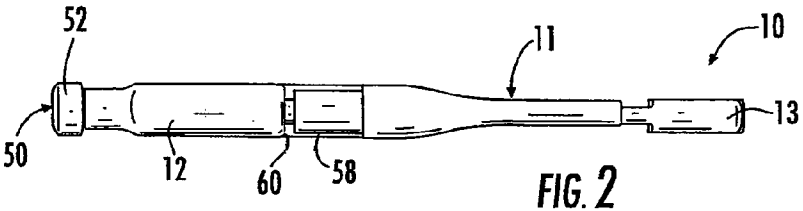
FIG. 2 is a top view of the pliers of FIG. 1.
Figure 3:
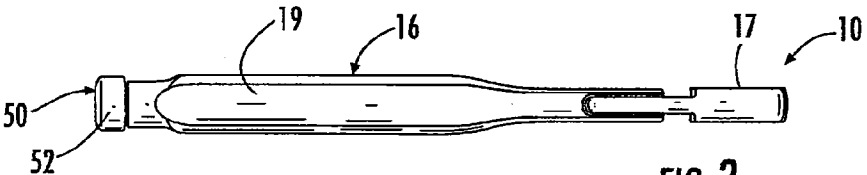
FIG. 3 is a bottom view of the pliers of FIG. 1.
Figure 4:
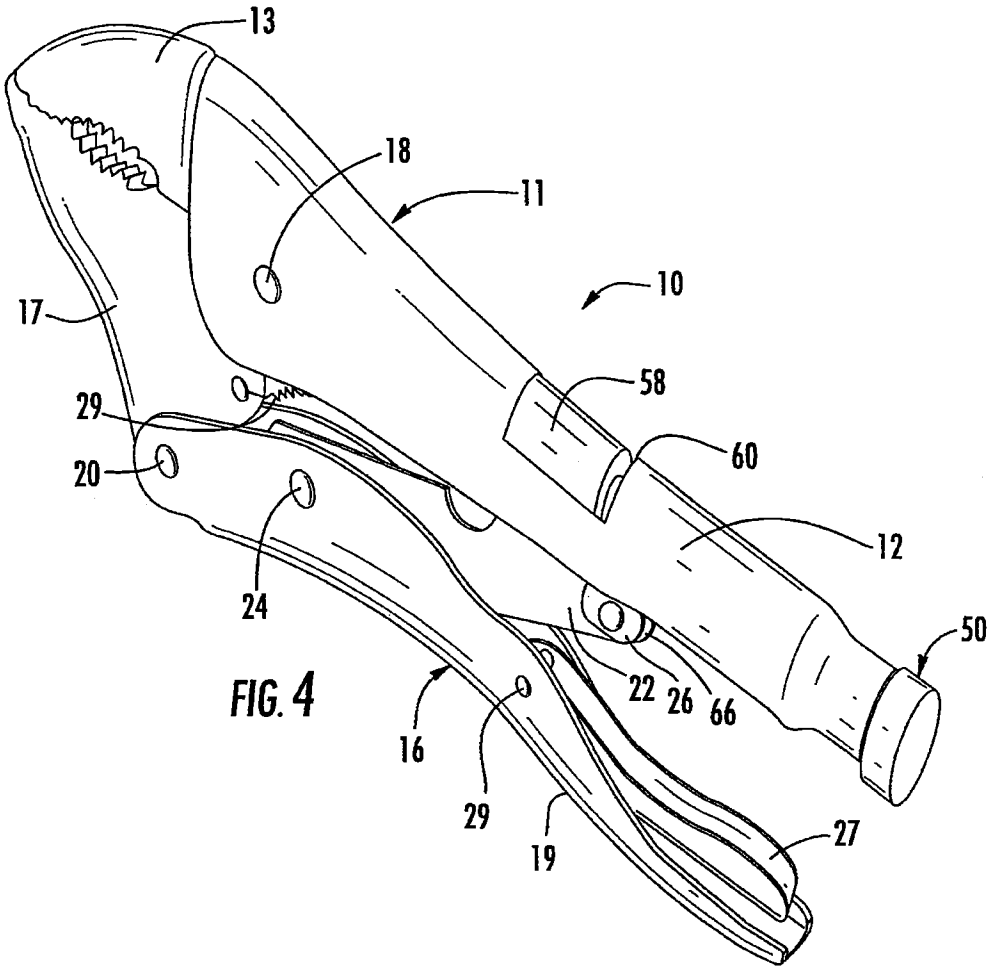
FIG. 4 is a perspective view of the pliers of FIG. 1.
Figure 5:
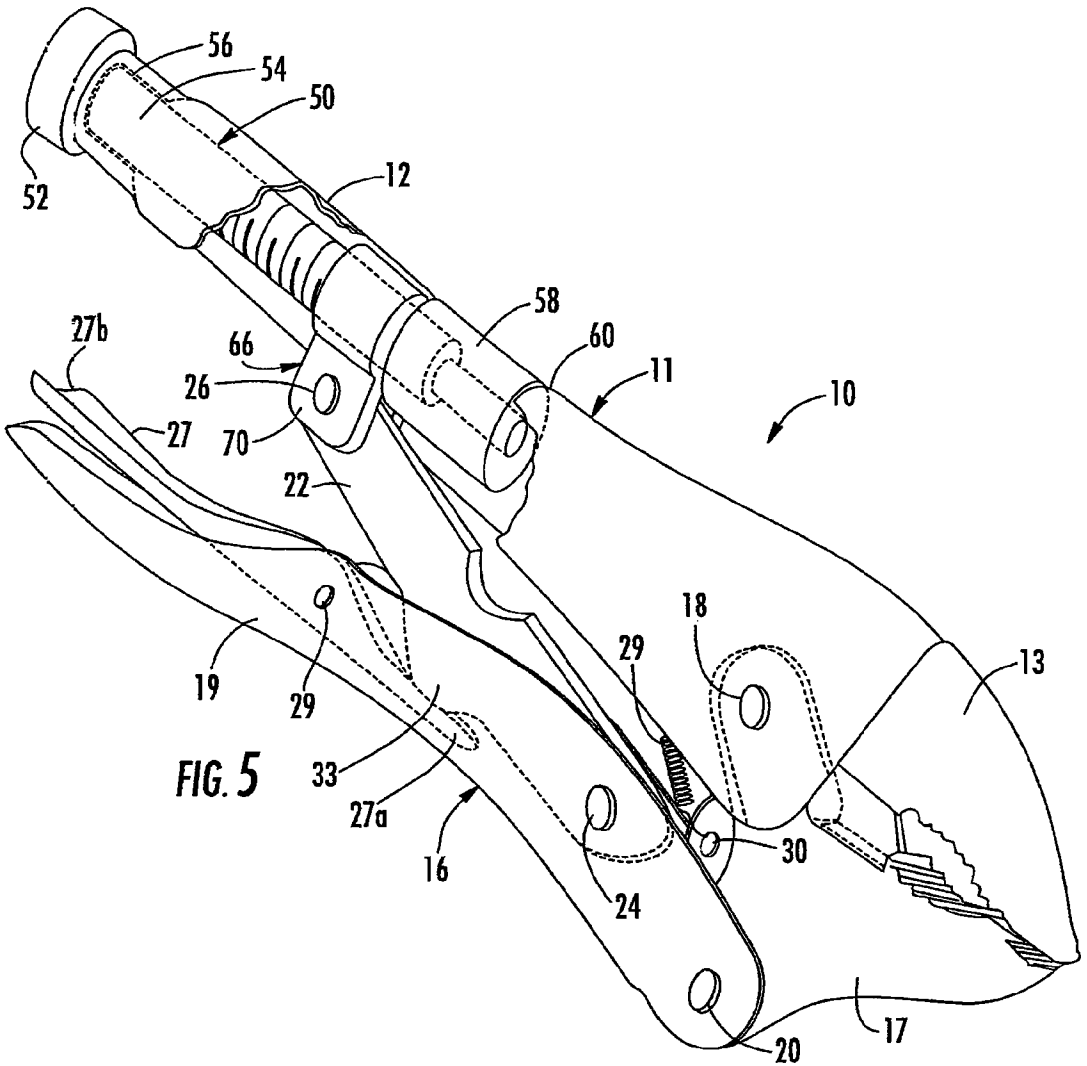
FIG. 5 is a partially cut-away perspective view of the pliers of FIG. 1.

Referring to FIG. 1, the actuating mechanism 58 is located between the ends of the fixed arm 11 such that it will be positioned approximately at the user's thumb T when the user grips the locking pliers. In one embodiment the actuating member 58 is approximately centrally located along the fixed arm 11. It is contemplated that the user will normally grip the locking pliers 10 such that the fingers F of one hand grip the movable handle 19 and the thumb T of the same hand grips the fixed handle 12. If a reverse grip is used where the fingers grip the fixed handle 12 and the thumb grips the movable handle 19, the rotary actuator will be located near the index finger of that hand.

As collar 66 moves up and down the length of the fixed arm 11, the effective length of the locking mechanism is changed to vary the spacing between the fixed and movable jaws in the clamped or locked position. Rotation of adjusting screw 50 changes the distance between pivot 26 and the pivot point 18 of the movable jaw 16. By varying this distance the space between the jaws 13, 17 and the clamping force exerted by the jaws on a work piece may be varied and the jaws may be adjusted to grip objects of varying size with varying force.

Figure 11:
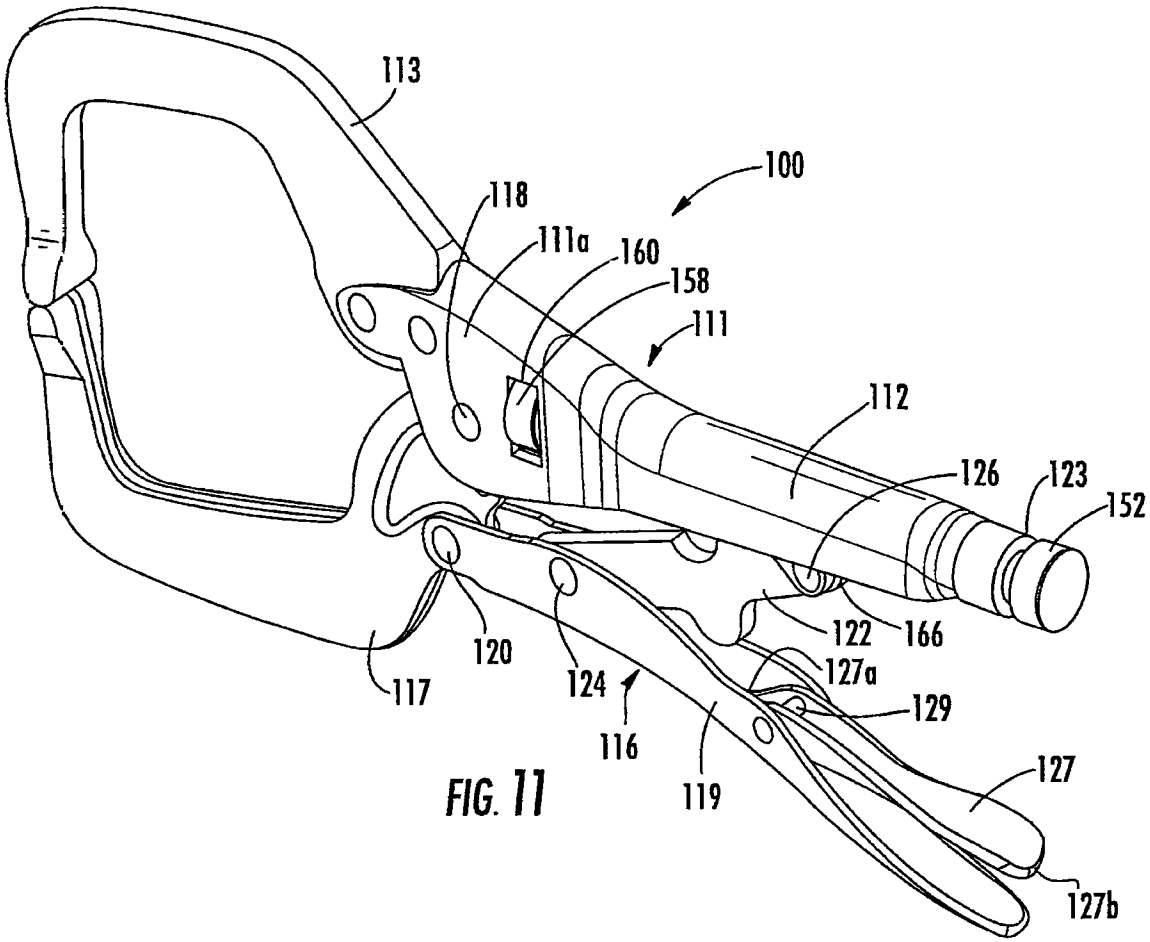
FIG. 11 is a perspective view of a second embodiment of a locking pliers showing the one-hand adjustment mechanism.
Figure 12:
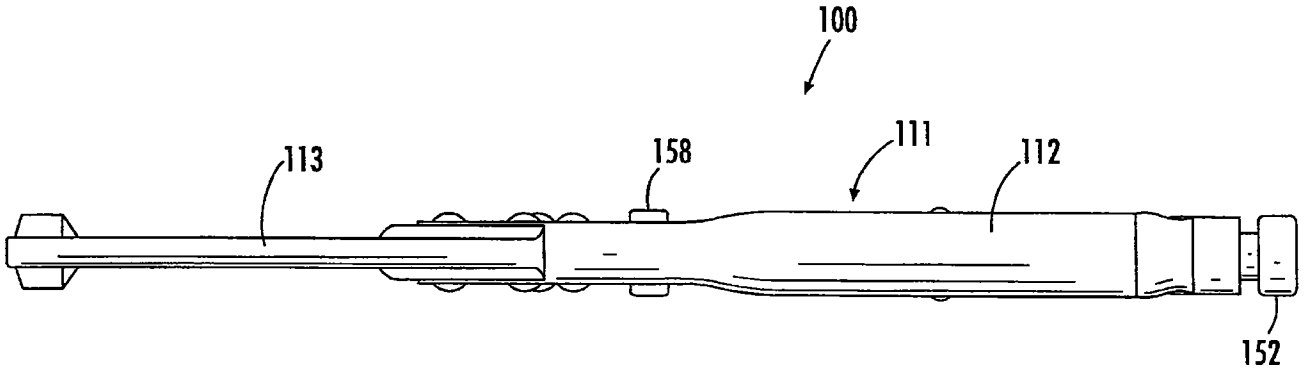
FIG. 12 is a top view of the pliers of FIG. 11.

An alternate embodiment of the locking pliers of the invention is shown in FIGS. 11 through 14. The arrangement of the fixed and movable arms and the locking mechanism is substantially the same as described with reference to the embodiment shown in FIG. 1. The locking pliers 100 include a fixed arm 111 having a fixed handle 112 at one end and a fixed jaw 113 at the other end. A movable arm 116 comprises a movable handle 119 is attached to a movable jaw 117 at pivot 120. The jaws illustrated in FIGS. 11 through 14 have a different configuration than the jaws 13 and 17 of the embodiment shown in FIG. 1. The jaws shown in the embodiment of FIG. 1 are intended to be used as a pliers while the jaws illustrated in FIG. 11 are intended to be used as clamps. It is to be understood that the different jaws may be used with either embodiment of the locking pliers and that numerous other configurations of the jaws may also be used with either embodiment of the locking pliers.

A pivot pin 118 connects the movable jaw 117 to the fixed arm 111. A link 122 connects the movable arm to the fixed arm 111 to lock the jaws 113 and 117 relative to one another. One end of link 122 is pivotably connected to collar 166 by pivot pin 126. While a particular embodiment of the locking mechanism is shown it is to be understood that the locking mechanism may have a variety of configurations including the one-hand locking mechanism described herein. A release lever 127 may be pivotably connected to arm 116 at pivot 129 such that user may depress the end 127*b* of lever 127 move the opposite end 127*a* of the lever to move link 122 to unlock the locking mechanism.

A screw 150 is located in the fixed arm 111 such that the longitudinal axis of the screw is disposed along and located in the fixed arm 111. In one embodiment in order to maintain the dimension of the fixed handle at a similar dimension to existing locking pliers a screw having a 5/16 inch diameter may be used. In one embodiment a thread pitch of about 14 threads per inch may be used to prevent the collar 166 from backdriving on the screw 150 and that requires a low turning force. Screw 150 is formed with a first actuating mechanism comprising an enlarged head 152 that extends from the distal end 123 of the fixed arm 111 and that can be manually rotated to adjust the locking pliers. A bearing surface 154 is formed adjacent the enlarged head 152 that is received in a through hole 156 formed in the fixed arm 111 such that the surface 154 is supported by and can rotate relative to the fixed arm. The opposite end of the screw 150 is connected to a second actuating mechanism 158. In one embodiment the actuating mechanism 158 comprises a rotary actuating member such as a cylindrical disk that is fixed to the screw 150 and extends through a cut-outs or apertures 160 formed in one or both of the sides of fixed arm 111 to rotatably retain the screw 150 in the fixed arm 111. The actuating member of mechanism 158 can be rotated by the thumb of the user to rotate screw 150 within fixed arm 111. The actuating member 158 may comprise a knurled knob that is connected to the end of screw 150. The actuating mechanism 158 is mounted in the fixed arm 111 such that the actuating member may be rotated relative to the fixed arm but is otherwise fixed to the arm. Rotation of the actuating mechanism 158 results in rotation of the screw 150 about its longitudinal axis. While the actuating mechanism 158 is shown as a rotary member connected directly to the screw, the actuating member may be connected to the screw via other elements such as a transmission comprising a gear train or the like. Further, the actuating mechanism could move other than rotationally provided that it is capable of rotating screw 150. Screw 150 does not translate relative to handle 112 along its longitudinal axis when it is rotated.

Screw 150 is dimensioned such that the actuating mechanism 158 is located near the end of arm 111 close to the pivot point 118 of the movable jaw 117. This arrangement differs slightly from the embodiment shown in FIG. 1 where the actuating member 58 is located nearer to the center of the fixed arm 11. The location of the actuating member 158 closer to the end of the fixed arm 111 and nearer to the pivot 118 of the movable jaw 117 may make manipulation of the actuating member more comfortable in certain applications. Further, the placement of the actuating member 158 closer to the pivot point 118 of the movable jaw 117 and in the area 111*a* of arm 111 that is relatively wider and thicker and has more material than handle 112 can effectively increase the strength of the pliers in certain applications.

Figure 13:
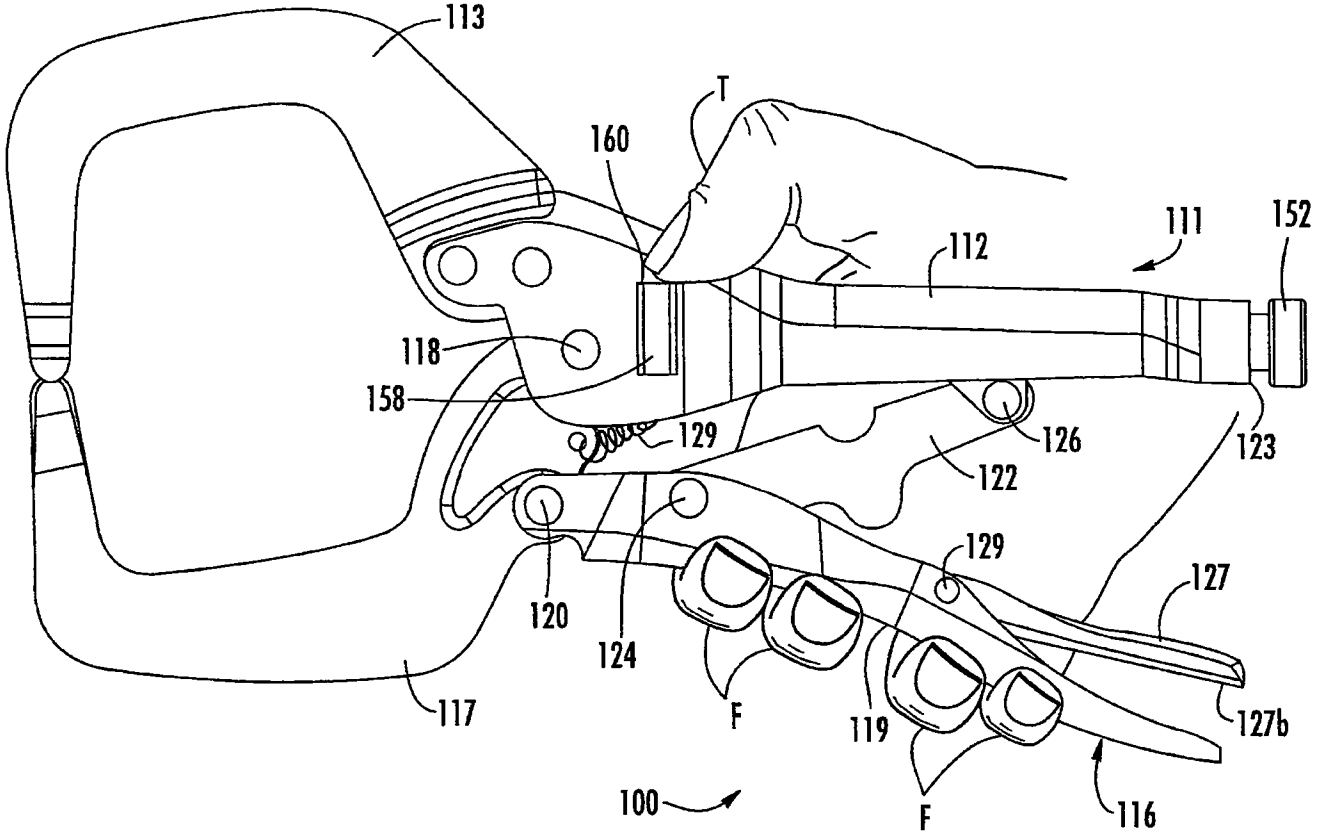
FIG. 13 is a side view of the pliers of FIG. 11.
Figure 14:
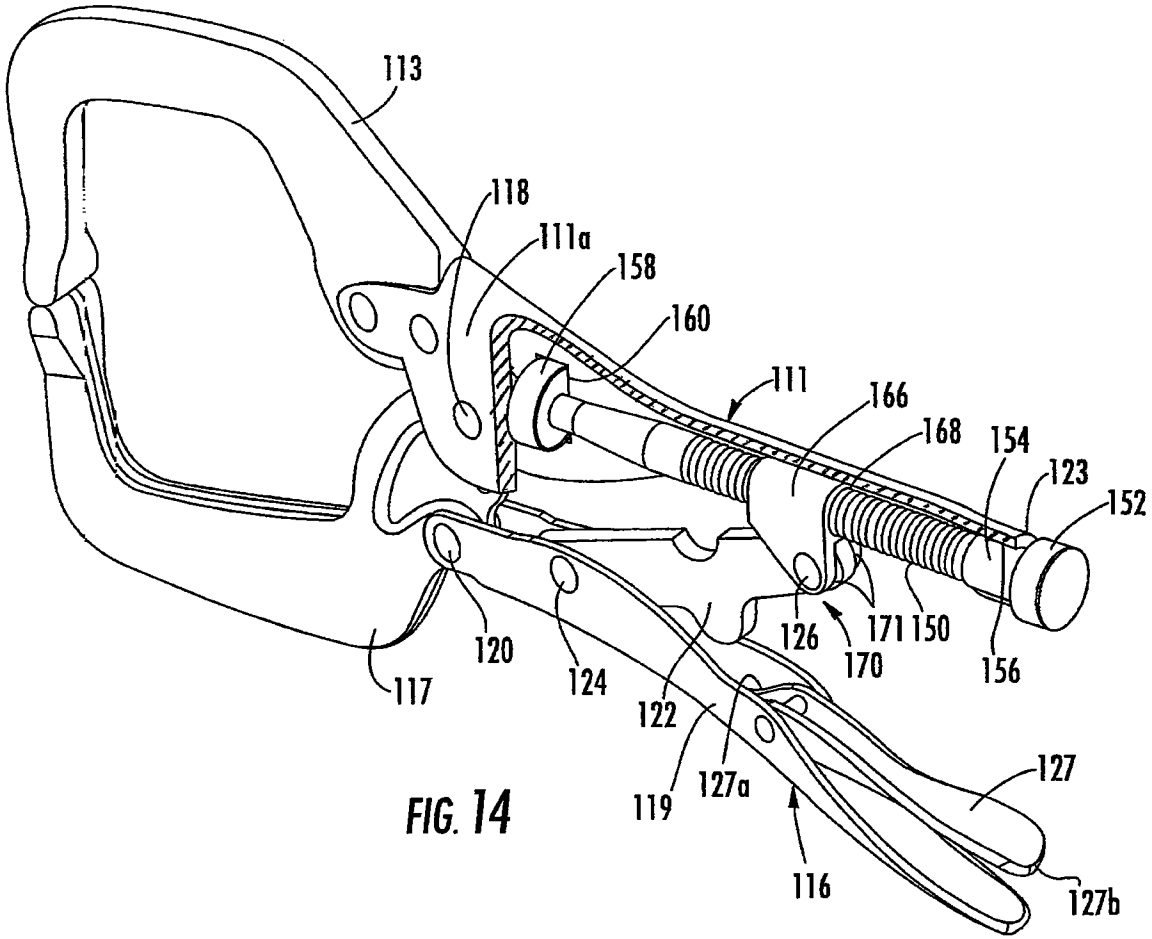
FIG. 14 is a partially cut-away perspective view of the pliers of FIG. 11.

Referring to FIG. 13, the actuating member 158 is located between the ends of the fixed arm between the first actuating mechanism 152 and the jaw 213 such that it will be positioned approximately at the user's thumb T when the user grips the locking pliers. It is contemplated that the user will normally grip the locking pliers 100 such that the fingers F of one hand grip the movable handle 119 and the thumb T of the same hand grips the fixed handle 112. If a reverse grip is used where the fingers grip the fixed handle 112 and the thumb grips the movable handle 119, the rotary actuator will be located near the index finger of that hand.

As described with reference to the embodiment shown in FIG. 1 a collar 166 having a threaded bore 168 is located on the screw 150 such that the external threads of screw 150 engage the internal threads of collar 166. As a result, as screw 150 is rotated, either by rotation of the first actuating mechanism 152 or by rotation of the second actuating member 158, the collar 166 is moved in a straight line up and down the length of screw 150 and fixed arm 111. The collar 166 includes a yoke 170 that extends from the fixed handle 112 and into the space between the fixed handle 112 and the movable handle 119. Yoke 170 includes a pair of flanges 171 that define aligned bores and are spaced to receive the end of link 122 therebetween. Holes formed in flanges 171 receive pin 126 that connects the collar 166 to the link 122 such that the link 122 can rotate relative to the collar 166.

As collar 166 moves up and down the length of the fixed arm 111, the effective length of the linkage is changed to vary the spacing between the fixed and movable jaws in the clamped or locked position as previously explained. By varying this spacing the clamping force exerted by the jaws on a work piece may be varied and the jaws may be adjusted to grip objects of varying size with varying force.

Operation of the locking pliers will now be described. The locking pliers may be adjusted using a traditional two hand operation or it may be adjusted using a one hand operation. The user has the option with the locking pliers of using either of two actuating mechanisms, the enlarged head 52, 152 (two hand) or the actuating member 58, 158 (one hand), to adjust the pliers. If the user opts to use the enlarged head 52, 152 the user holds the pliers with one hand and adjusts the pliers with the other hand using head 52, 152. If the user opts for one-handed operation, the user grips handles 12, 112 and 19, 119 with one hand such that the fingers grip handle 19, 119 and the thumb is disposed adjacent actuating member 58, 158. The user rotates actuating member 58, 158 with the fingers or thumb of the same hand that holds the pliers. The location of the actuating member along fixed arm 11, 111 allows the actuating member 58, 158 to be manipulated by the same hand that grips the pliers. The user then has free use of their other hand to, for example, hold the workpiece(s) that are to be engaged by the pliers.

Figure 15:
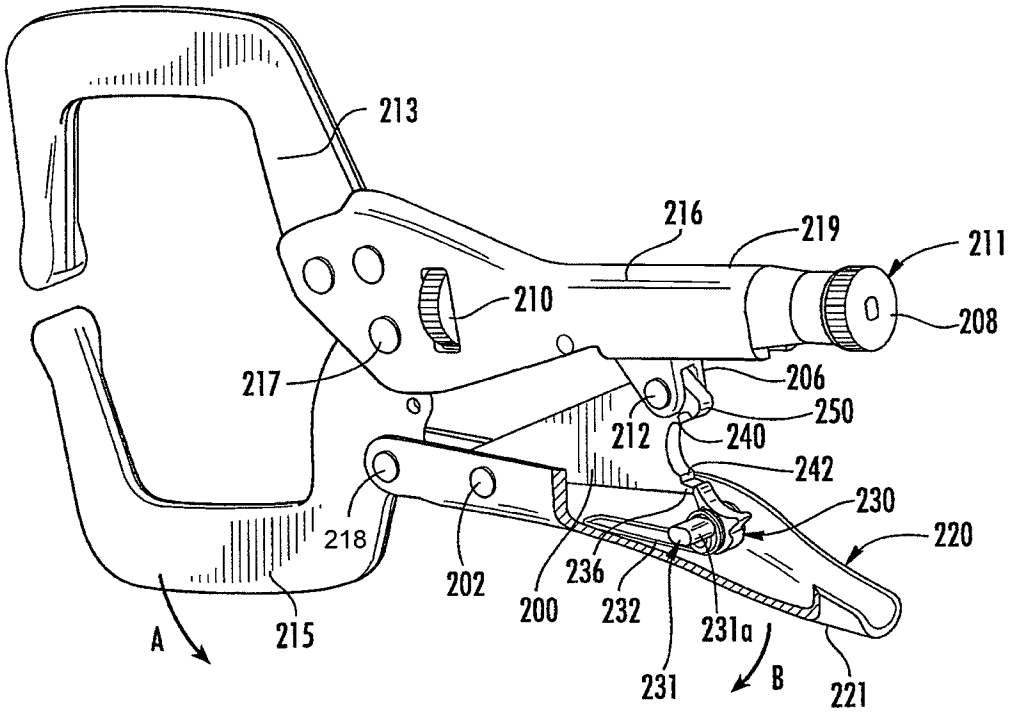
FIGS. 15, 16 and 17 are partially cut-away perspective views of another embodiment of a locking pliers showing the one-hand locking mechanism.
Figure 16:
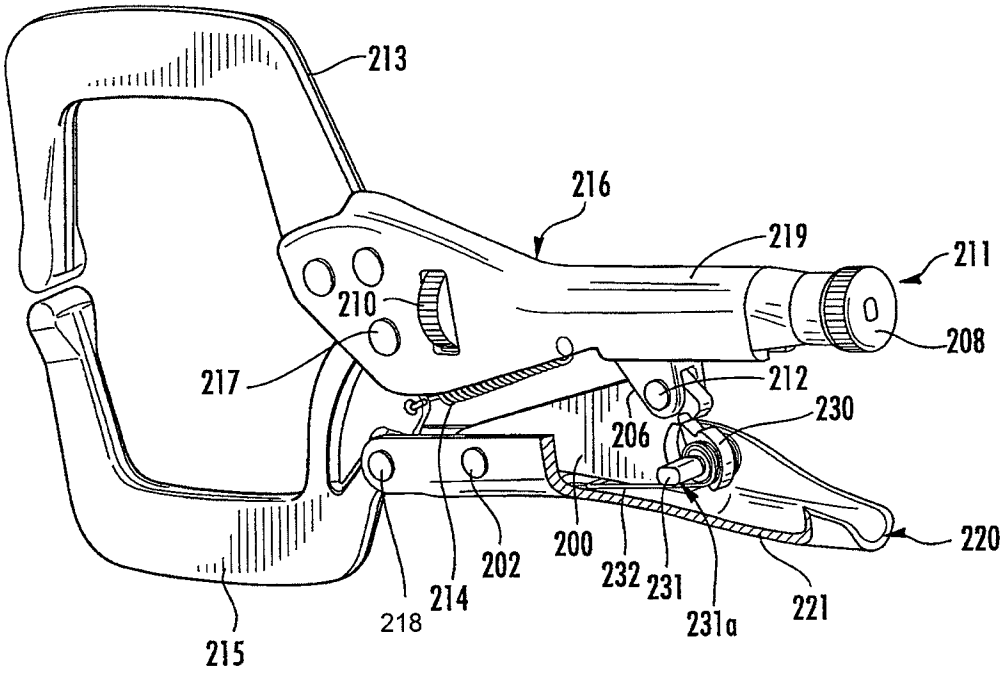
Figure 17:
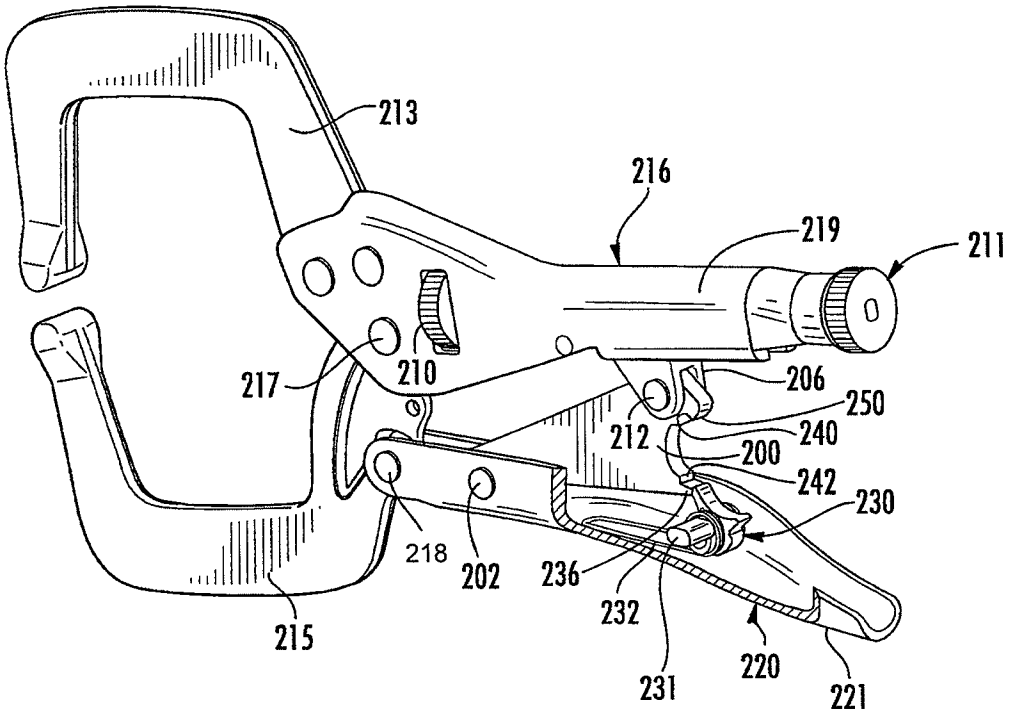

An embodiment of the one-hand locking mechanism will be described with reference to FIGS. 15 through 29. For purposes of explaining the construction and operation of the locking mechanism of the invention, one such locking tool will be described in detail with reference to the figures. Referring to FIGS. 15, 16 and 17, the tool includes a fixed arm 216 having a fixed handle 219 at one end and a fixed jaw 213 at the other end. A movable arm 220 is pivotably connected to movable jaw 215 by pivot pin 218 and forms movable handle 221. A pivot pin 217 connects the movable jaw 215 to the fixed arm 216 such that the jaws may pivot towards and away from one another. The movable arm 220 moves toward and away from fixed arm 216 to close and open the jaws. The jaws 213 and 215 may be shaped to function as long nose pliers, pliers with curved jaws, serrated jaws, C-clamps, C-clamps with swivel pads, hole punches, or any other kind of hand tool where the locking action is useful.

The locking mechanism comprises a link 200 that has one end connected to the movable arm 220 at pivot 202 and the opposite end connected to movable collar 206 at pivot 212. Collar 206 is connected to an adjustment screw 211 that can be adjusted using either the head 208 or the one-hand adjustment mechanism 210 as a previously described. Rotation of screw 211 moves the collar along the fixed arm 216 towards and away from the fixed jaw 213 to change the angle and effective length of link 200 relative to the arms. Changing the position of pivot 212 changes the distance between the jaws 215 and 213 when the jaws are closed to thereby change the force applied by the jaws to a work piece. A spring 214 (FIG. 16) is connected between fixed arm 216 and movable jaw 215 such that the spring 214 is under tension and will tend to pull jaw 215 away from jaw 213 and movable arm 220 away from arm 216, as represented by arrows A and B, respectively. The one-hand locking mechanism is shown in a C-clamp that uses the one-hand adjustment mechanism previously described with respect to FIGS. 1-14; however, the one-hand locking mechanism may be used with a locking tool that uses a traditional adjustment mechanism.

Link 200 comprises stops that cooperate with a catch 230 that allow the pliers to be locked and unlocked with one hand. Link 200 also comprises a stub 236 that is positioned to engage and rotate the latch. A first stop 240, a second stop 242 and a third stop 250 are formed on link 200 to engage the catch 230 as the pliers are locked and unlocked as will be described.

Catch 230 is pivotably mounted on the movable arm 220 by a pin 231. The catch 230 includes hole for receiving the pin 231 such that the pin acts as a pivot axis about which the catch 230 rotates. A torsion spring 232 biases the catch clockwise, as viewed in the figures, to the position of FIG. 18. The catch 230 comprises a first lobe 234 and a second lobe 238 that extend from the catch where they can engage the link 200. The lobes are positioned such that the lobes may engage the stub 236 and the first stop 240, second stop 242 and third stop 250 of link 200 during the locking and unlocking operations as will hereinafter be described.

The pin 231 may be used to function as a safety to prevent the catch 230 from being inadvertently released when the pliers are in the locked position. To provide the safety, pin 231 may comprise an elongated member having a round cylindrical portion about which the catch 230 may rotate and a non-round portion 231*a* that may be pushed into the hole formed in the catch 230 to lock the catch in position relative to the pin 231 and prevent it from inadvertently rotating when the pliers are in the locked position. The user may move the safety to the safety-on position to prevent the pliers from unlocking when in use and to the safety-off position to unlock the pliers. The safety mechanism may also be eliminated such that the catch is always free to rotate about the pin.

Figure 18:
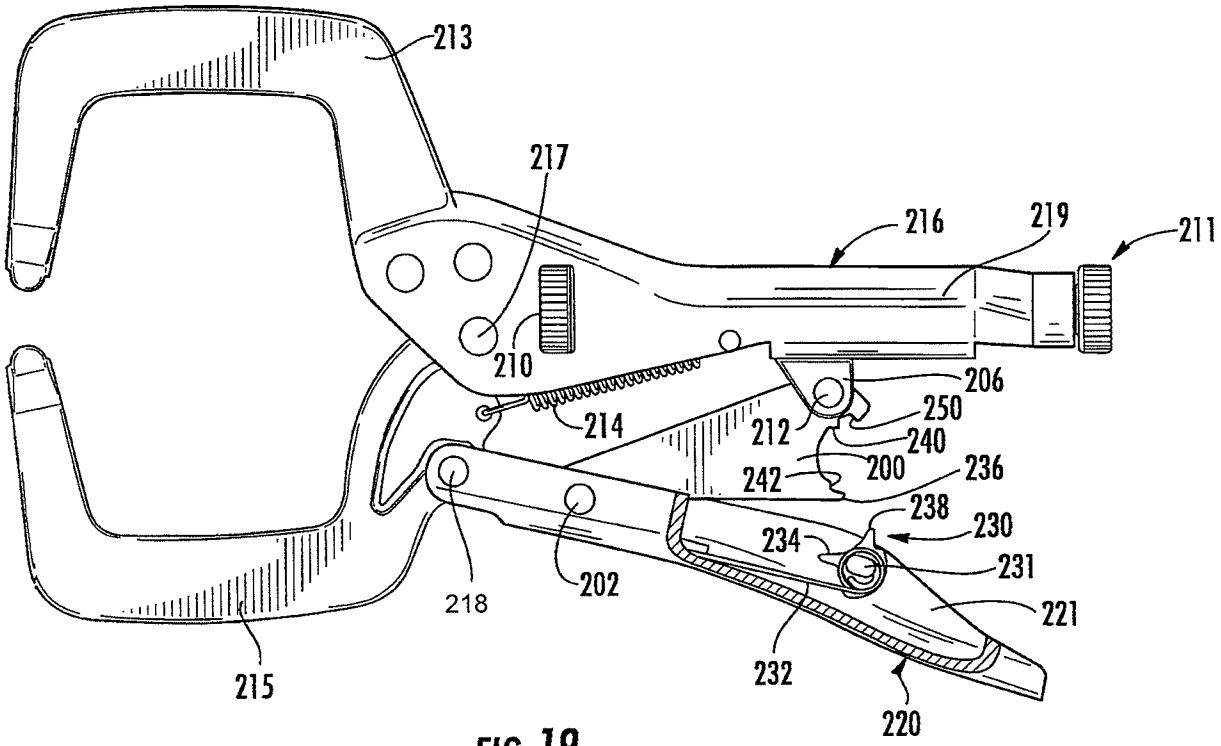
FIGS. 18 through 29 are partially cut-away side views of the pliers of FIG. 15 showing the sequence of operation of the locking mechanism.

FIG. 18 shows the locking tool in the open position where the one-hand locking mechanism is not engaged and the arms 216, 220 and jaws 213, 215 are freely movable relative to one another. The position of pivot pin 212 along the length of the fixed arm 216 may be adjusted by rotating either the screw head 211 or the adjustment mechanism 210 as previously described to adjust the spacing between the jaws 213, 215 and the force exerted by the jaws on a work piece.

Figure 19:
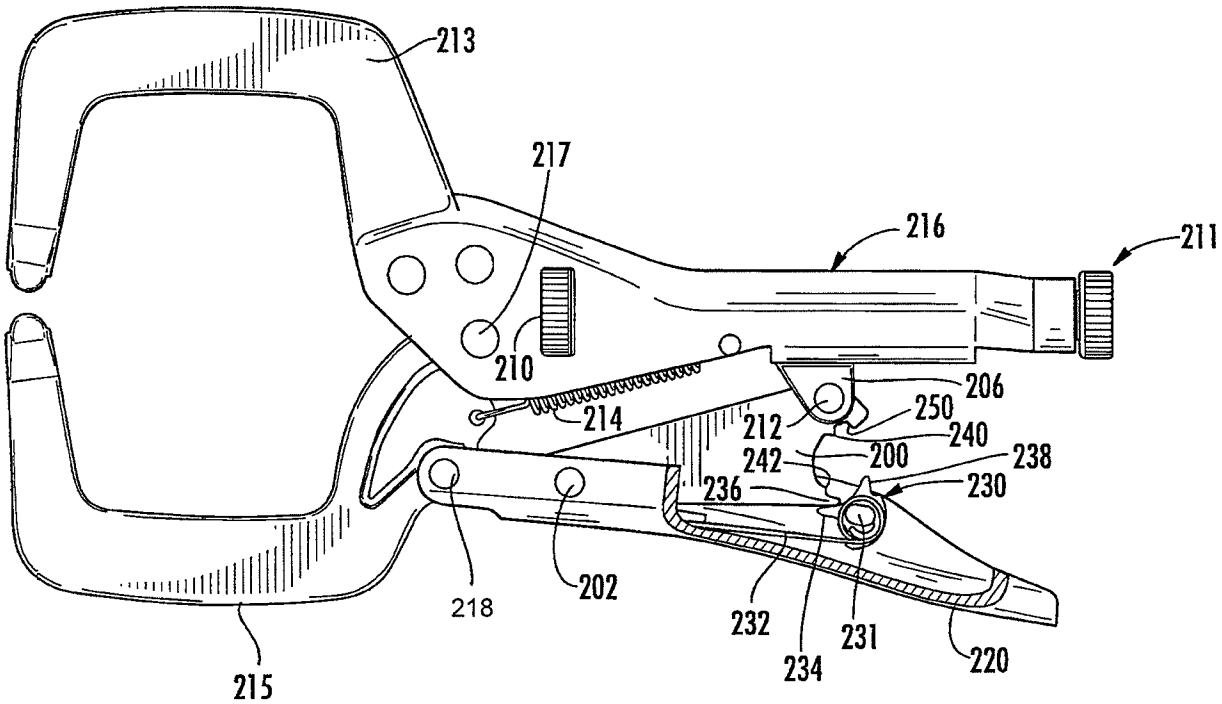
Figure 20:
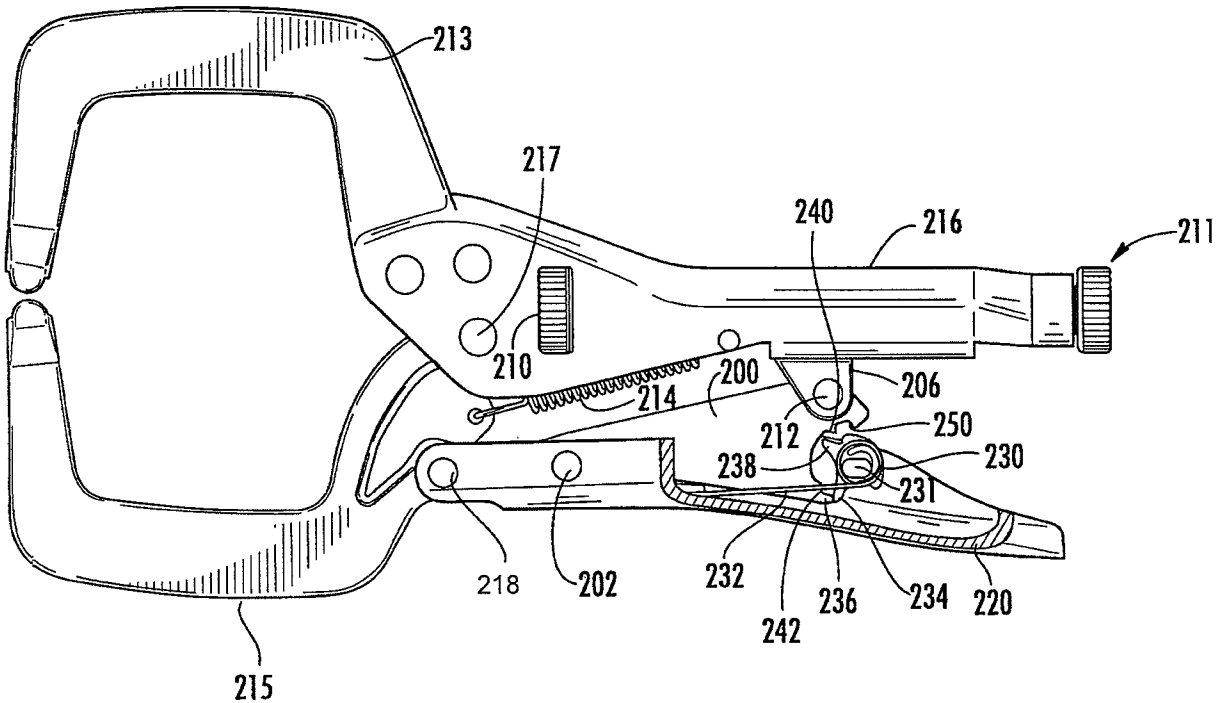

To close and lock the jaws 213, 215 on a work piece the arms 216, 220 are moved towards one another. Typically, the handles 219, 221 are squeezed between the fingers and thumb of one hand. As the arms 216, 220 are closed, the link 200 and the catch 230 are moved towards one another until the latching stub 236 on the link 200 contacts the first latching lobe 234 extending from the catch 230, FIGS. 18 and 19. In the illustrated embodiment the latching stub 236 is formed as a protrusion extending from link 200. Referring to FIG. 19, as the arms 216, 220 are moved further towards one another the latching stub 236 strikes and pushes against lobe 234 to begin to rotate the catch 230, counterclockwise as viewed in the figures. Continued closing of the arms 216 and 220 rotates the link 200 toward arm 220 such that catch 230 is rotated to the nearly fully rotated position of FIG. 20. In this position the catch 230 is rotated, counterclockwise as viewed in the figures, to nearly its fullest extent. Note, the spacing between the jaws 213, 215 can be adjusted by rotating the adjusting screw such that the jaw spacing may be changed.

Figure 21:
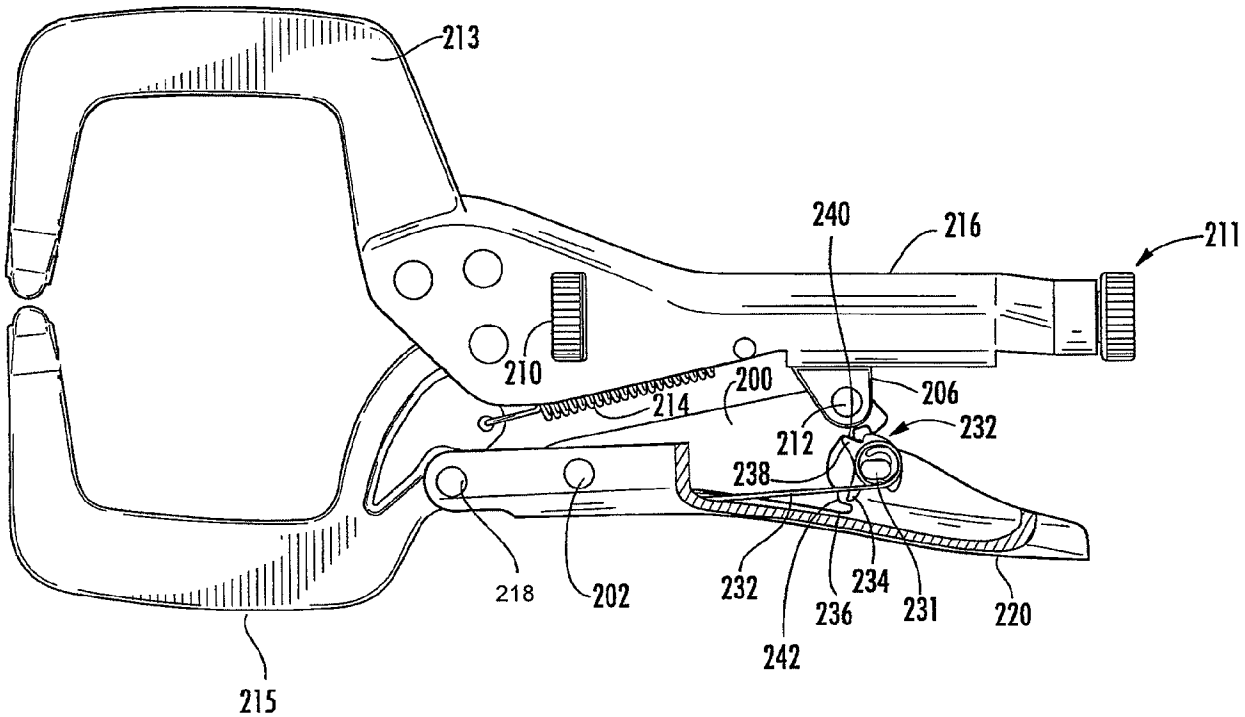

The arms 216, 220 are moved toward one another until the latching stub 236 moves past the end of lobe 234 and is disengaged from catch 230 as shown in FIG. 21. Once this position is reached the catch 230 immediately rotates clockwise as viewed in the figures under the force exerted by spring 232 until second lobe 238 on catch 230 engages a first stop 240 on link 200 to stop the catch 230 in the intermediate position shown in FIG. 21. In this position lobe 234 is disengaged from stub 236 and lobe 238 is in contact with stop 240 to temporarily hold catch 232 in the intermediate position.

Pressure on the movable arm 220 is then released slightly by the user allowing the movable arm 220 to move slightly away from fixed arm 216. As the movable arm 220 moves away from the fixed arm 216, lobe 238 is moved out of engagement with stop 240 to the position of FIG. 22. In moving from the position of FIG. 21 to the position of FIG. 22 the arms 216, 220 actually separate from one another a very slight distance as pressure on the movable handle is released slightly. This release of pressure mimics the movement in a traditional locking pliers when the locking mechanism moves through the on-center position to the locked over-center position.

Figure 22:
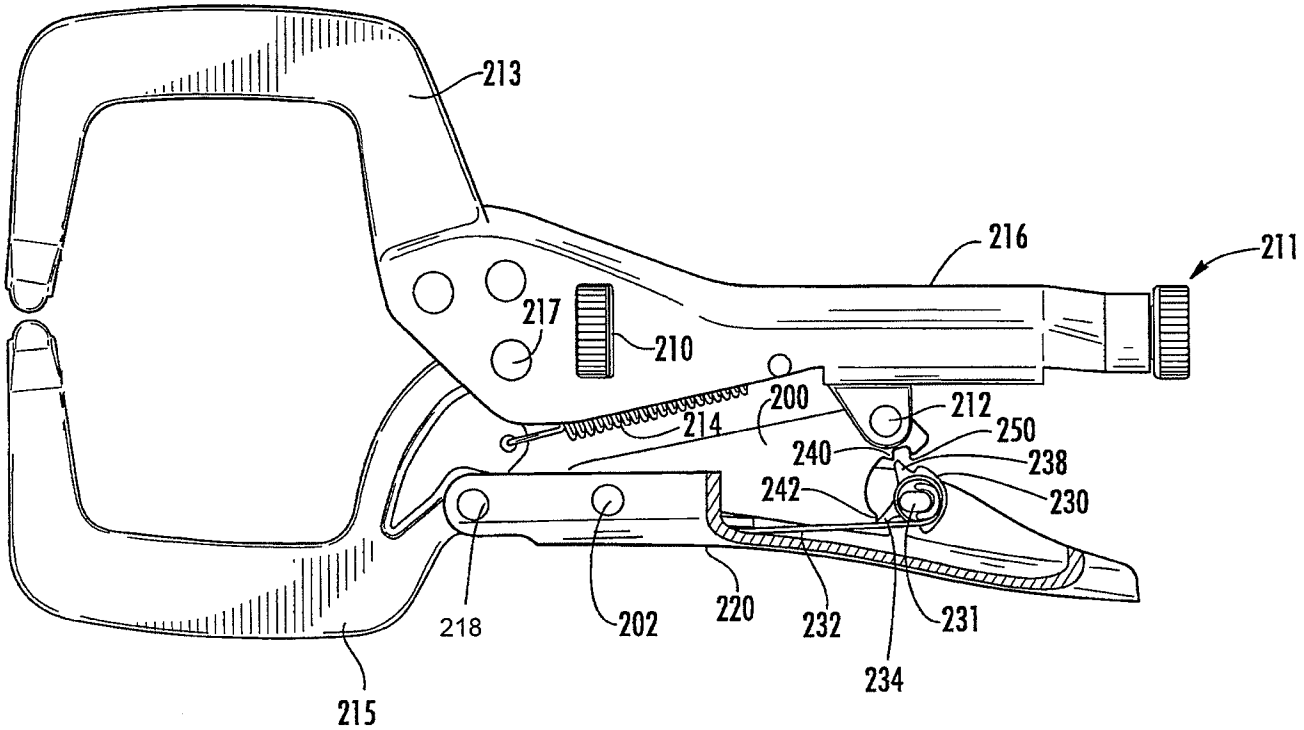

Once the second lobe 238 is disengaged from stop 240, spring 232 rotates the catch 230 (clockwise as viewed in the figures) until the first lobe 234 engages a second stop 242 formed on the link 200 as shown in FIG. 22. The stop 242 is formed as a slight pocket or flat surface on the link 200 that engages lobe 234 to prevent further relative rotation between the catch 230 and link 200. The engagement of catch 230 with link 200 prevents the rotation of the link 200 relative to arm 220 to lock the arms 216, 220 and jaws 213, 215 in position. In order for the arms 216, 220 to separate and the jaws 213, 215 to open the link 200 must be able to rotate about pivot 202. The position shown in FIG. 22 is the locked position where movement of link 200 relative to the handles is prevented such that the arms 216, 220 are prevented from moving away from one another and the jaws 213, 215 are in a locked position relative to one another. In the position shown in FIG. 22 the safety maybe engaged to prevent the rotation of the catch 230 and the inadvertent release of the locking mechanism. Disengagement of the safety allows the sequence to continue to the unlocked position as will be described with reference to FIGS. 23 through 29.

Figure 23:
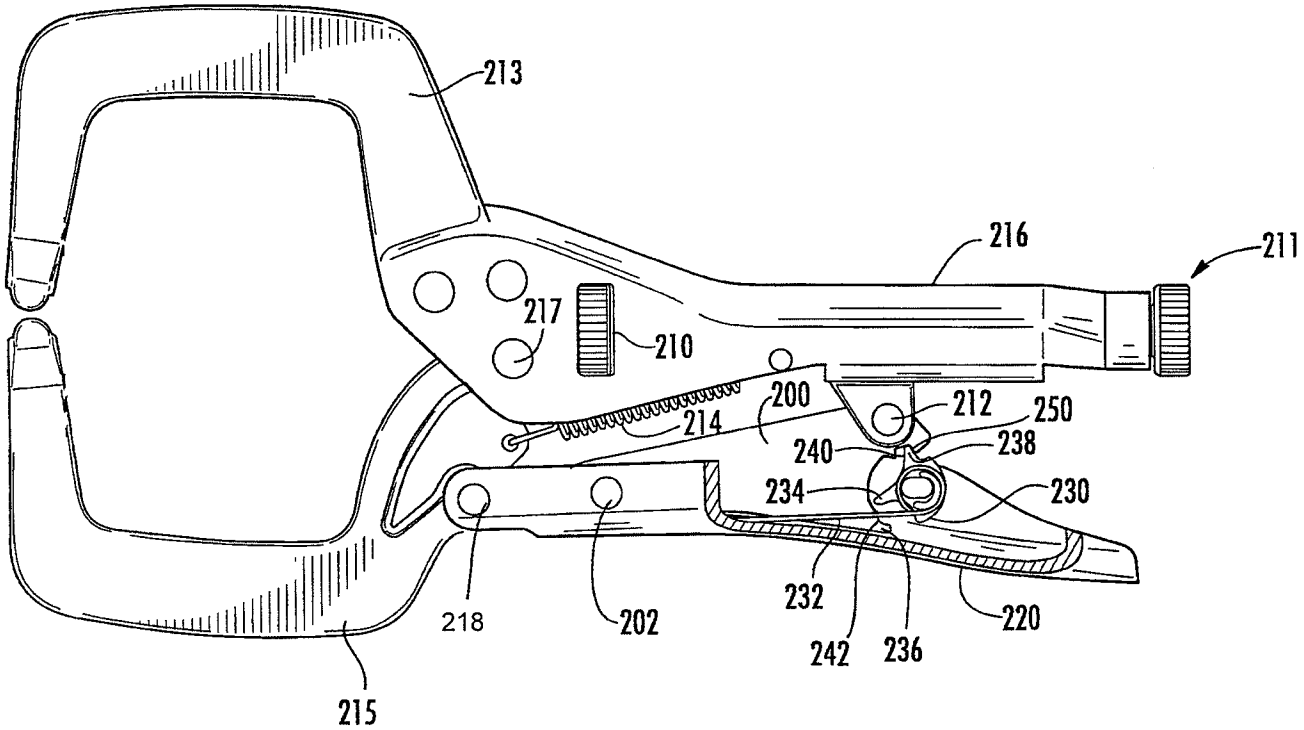
Figure 24:
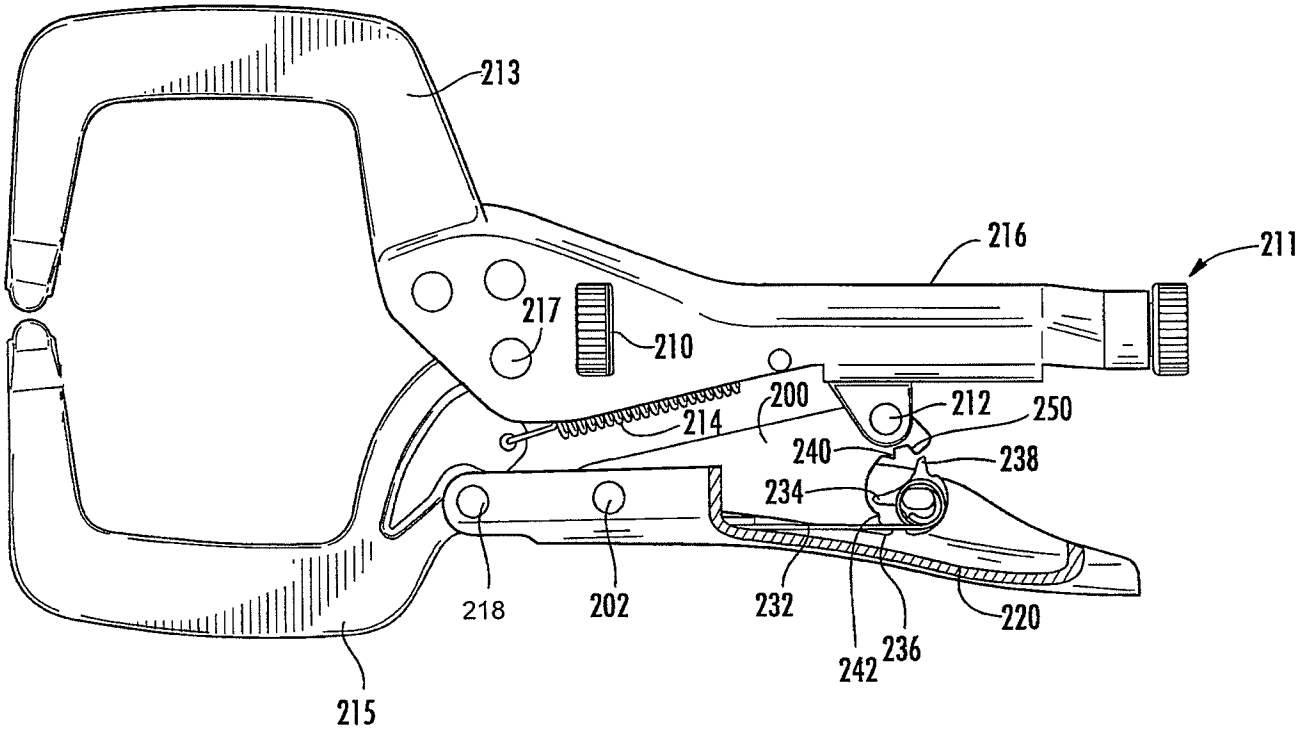
Figure 25:
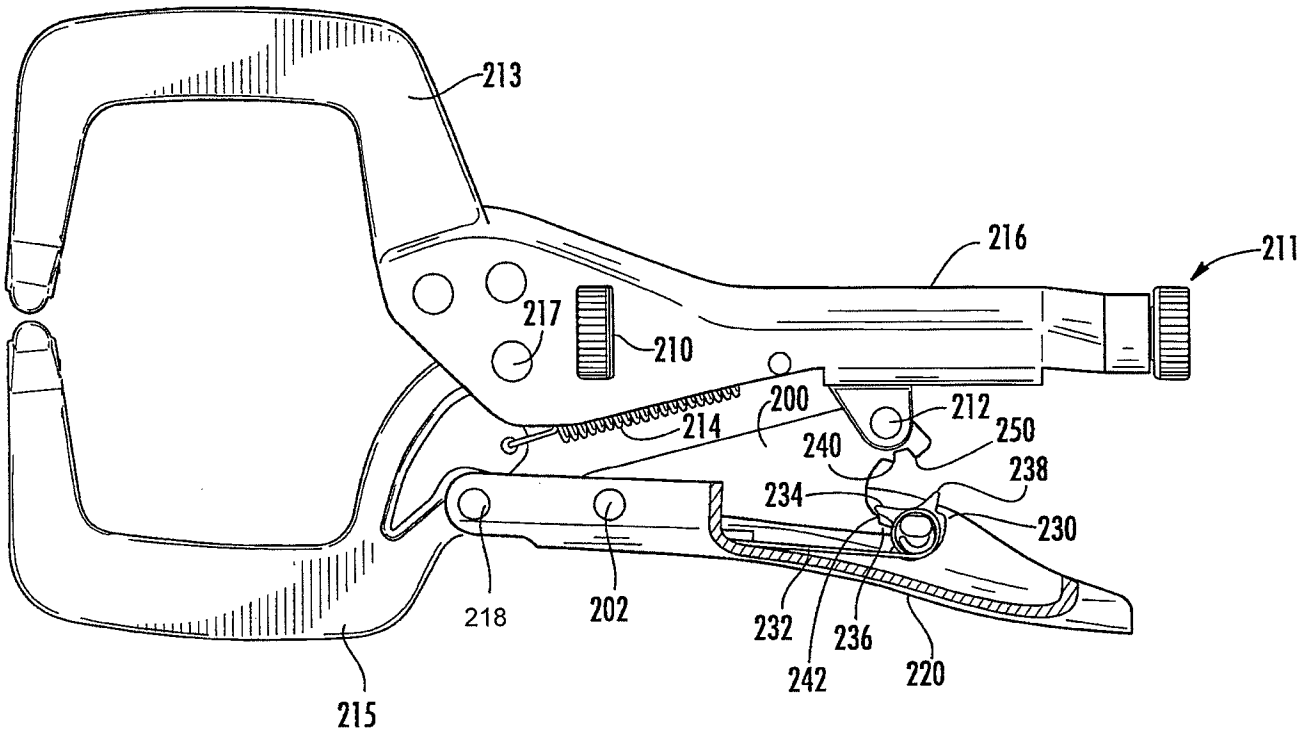
Figure 26:
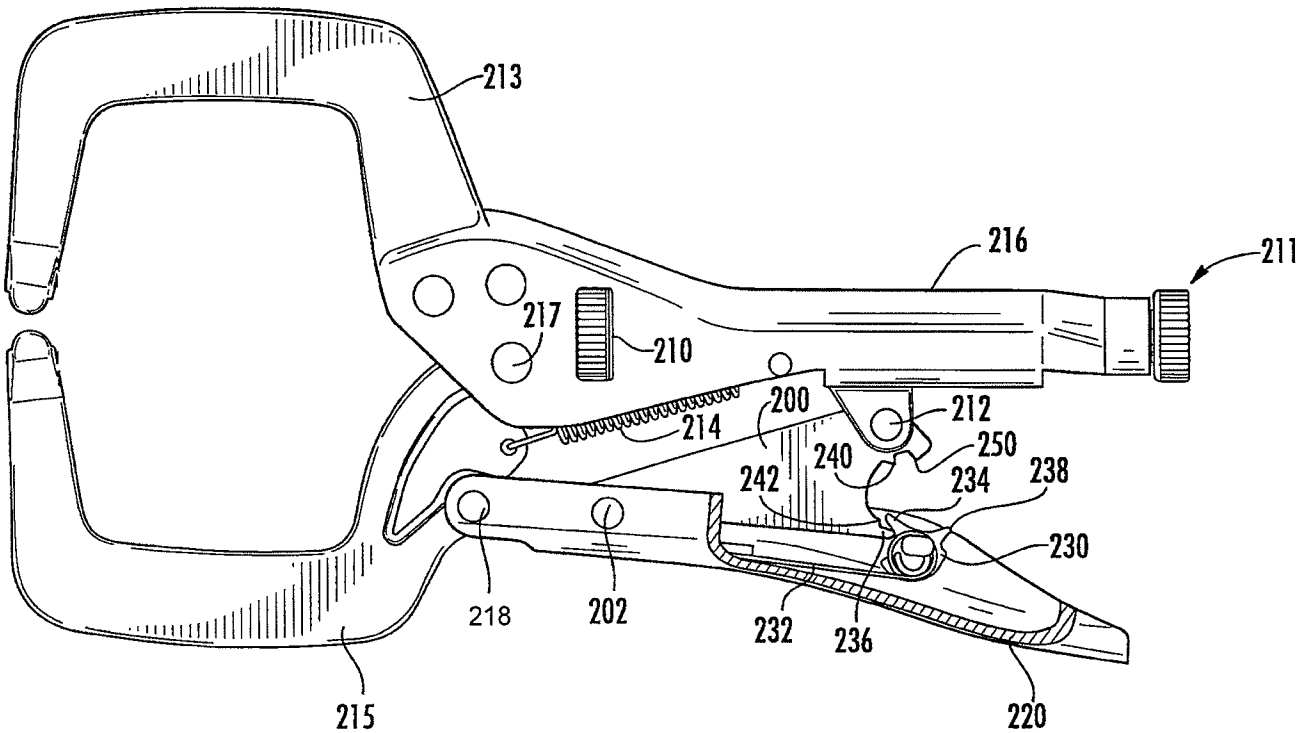
Figure 27:
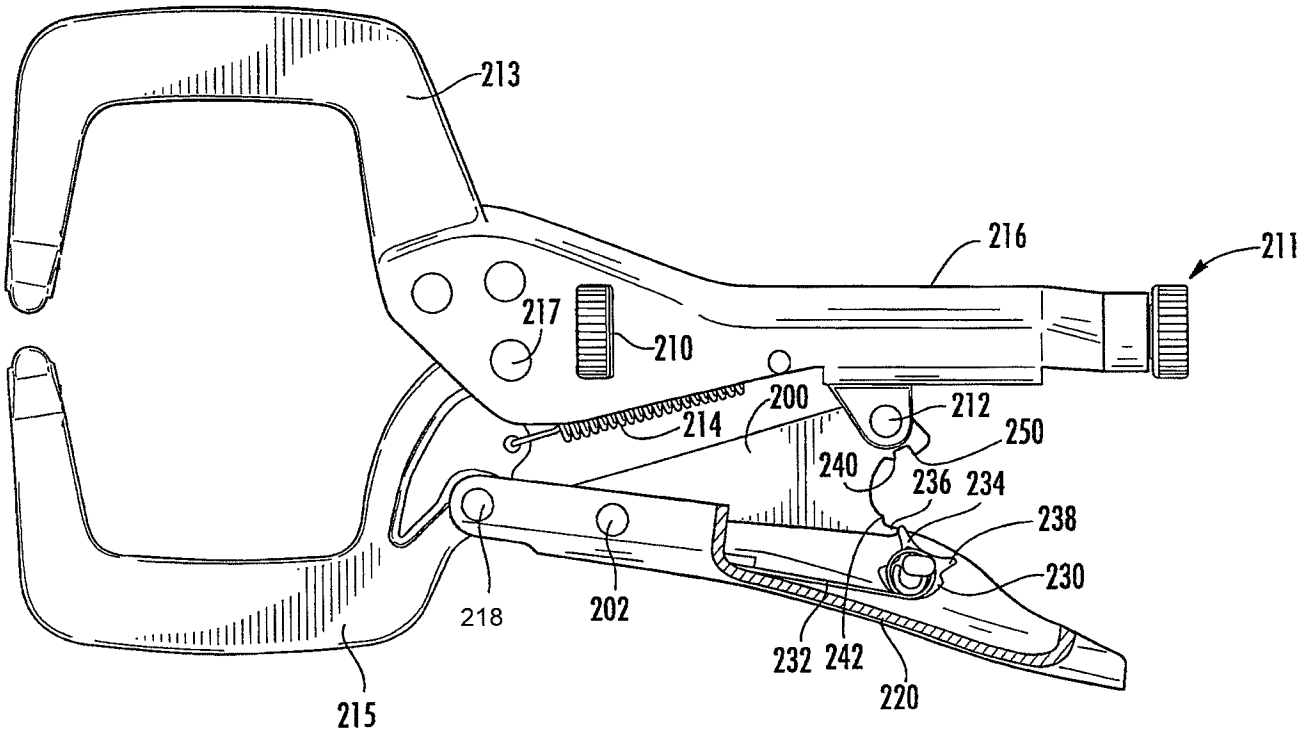
Figure 28:
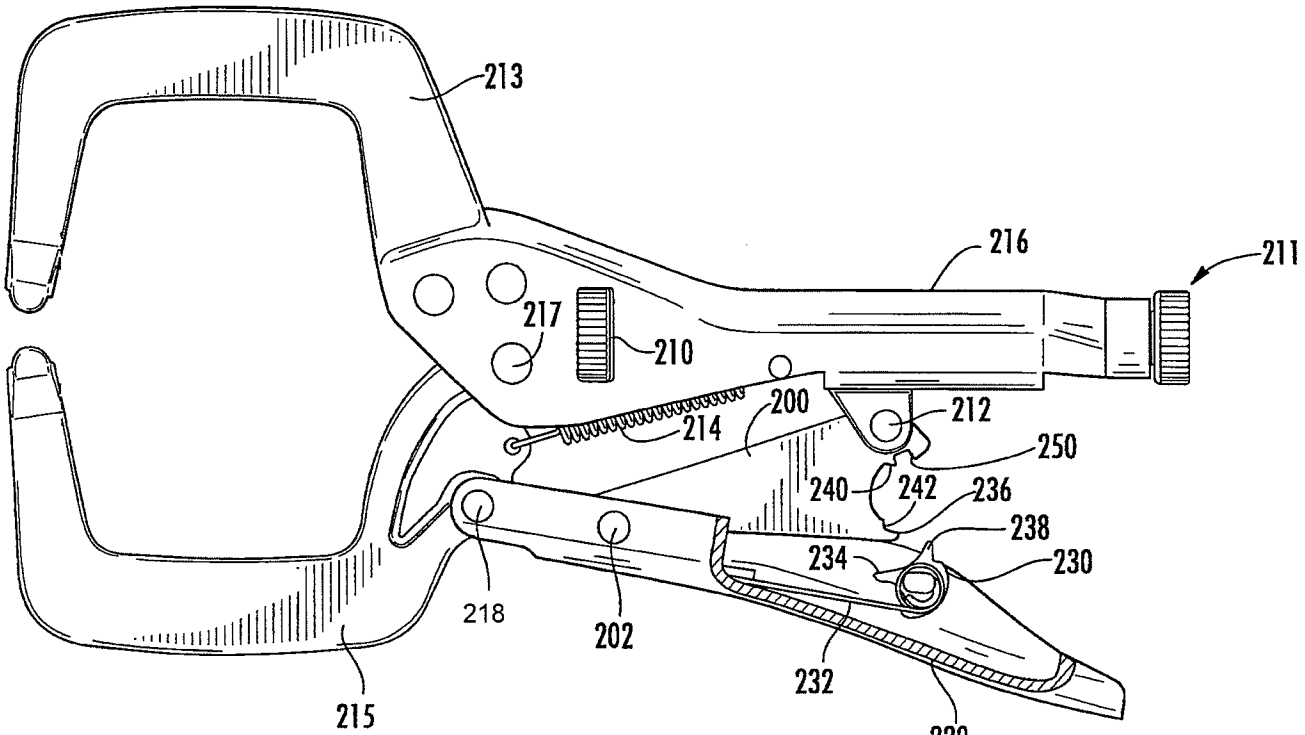
Figure 29:
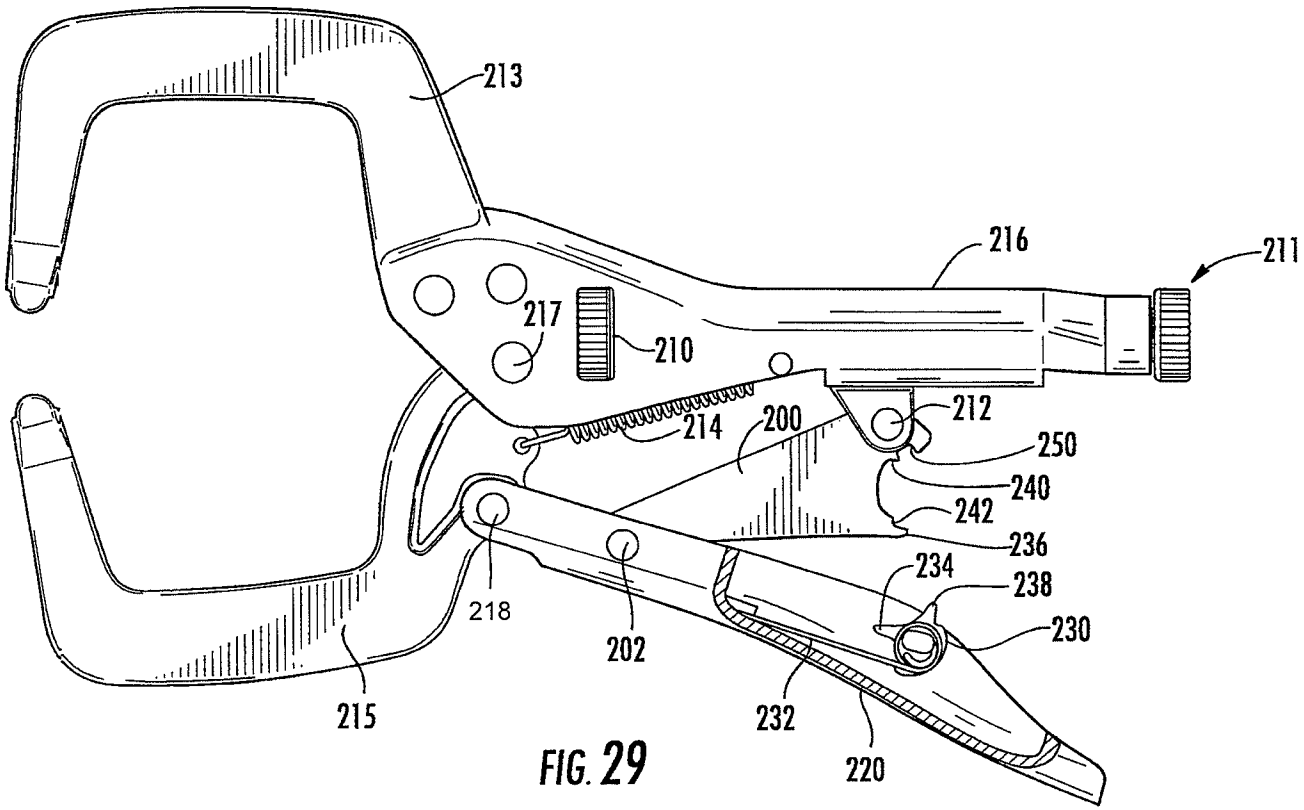

Referring to FIG. 23, to unlatch the locking mechanism and unlock the jaws, the movable arm 220 is moved toward the fixed arm 216 using the same hand and in the same manner as the handles were moved to lock the tool. As arm 220 moves slightly toward arm 216, link 200 and stub 236 are moved slightly toward movable arm 220 and relative to catch 230. Because spring 232 biases catch 230 clockwise as viewed in the figures, as the link 200 and stub 236 move slightly toward the movable arm 220, the lobe 234 of catch 230 is disengaged from stop 242 allowing spring 232 to pivot the catch 230 clockwise to the position of FIG. 23. In this position, the second lobe 238 of catch 230 engages a third stop 250 on the link 200 to limit the rotation of the catch 230. As arm 220 is further released as shown in FIG. 24 the secondary lobe 238 is disengaged from the stop 250 and the catch 230 is pivoted clockwise by spring 232 to the rest position shown in FIG. 24. As the movable arm 220 is moved toward the fully open position by spring 214, the link 200 contacts the latching lobe 234 of catch 230 causing the catch 230 to rotate clockwise past the rest position and allowing the stub 234 to move past the catch 230 as the handles open as shown in FIGS. 25, 26 and 27. Referring to FIG. 28 after the stub 236 clears and fully disengages from the catch 230, spring 232 rotates the catch 230 back to the rest position. The movable arm 220 continues to rotate to the fully open position under the force of spring 214, FIG. 29.

Thus, the pliers can be locked by moving the handles toward one another using the same motion of the handles as a traditional locking pliers. Once locked, the pliers can be unlocked and the jaws opened by simply squeezing the handles toward one another in the same manner, in the same direction and using the same hand as was done to lock the pliers. The handles are then released. As a result the pliers can be locked and unlocked using one-hand and using the same hand movement to both lock and unlock the pliers. Further, because of the placement of the adjustment mechanism 210, the distance between the jaws and the force exerted by the jaws on a work piece can be adjusted by the same hand while gripping the handles. Thus, the locking tool allows compete one-handed operation for locking, unlocking and adjusting the tool, freeing the user's other hand to hold a work piece or other task.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A locking tool comprising:

a first arm supporting a first jaw;

a second arm movable relative to the first arm between a first position and a second position;

a second jaw movable between a locked position when the second arm is in the first position and an unlocked position when the second arm is in the second position;

a link comprising a first stop and a second stop, the link being operatively connected to the first arm and to the second arm such that the link moves as the second arm moves between the first position and the second position;

a locking mechanism for locking the second jaw in the locked position the locking mechanism comprising a catch pivotably mounted relative to the second arm and biased in a first direction by a spring and having a first lobe and a second lobe extending from the catch that are positioned to engage the link, the link moving the catch from a rest position toward an intermediate position as the second arm moves between the second position and the first position by a first movement of the second arm toward the first arm, the first lobe engaging the first stop on the link to lock the second jaw in the locked position when the catch is in the intermediate position; and the first lobe being configured to disengage from the first stop to unlock the second jaw by a second movement of the second arm toward the first arm where the second movement of the second arm toward the first arm moves the link allowing the catch to rotate in a second direction under a force exerted by the spring to move the first lobe out of engagement with the first stop.

2. The locking tool of claim 1 further comprising an adjustment screw for adjusting the locking mechanism, a collar mounted on the adjustment screw that moves when the adjustment screw is rotated; and a first mechanism for rotating the adjustment screw and a second mechanism for rotating the adjustment screw.

3. The locking tool of claim 2 wherein the first mechanism is a head of the screw that extends from a distal end of the first arm.

4. The locking tool of claim 2 wherein the second mechanism is located at a position spaced from the first mechanism along the length of the first arm.

5. The locking tool of claim 4 wherein the second mechanism is rotatable.

6. The locking tool of claim 2 wherein the first arm has a first end and a second end, the second mechanism includes an actuating member located between the first end and the second end.

7. The lockable tool of claim 6 wherein the second mechanism is located such that the second mechanism may be manipulated by the fingers or thumb of a hand when the first arm and the second arm are gripped by said hand.

8. The locking tool of claim 2 wherein the second mechanism extends through an aperture formed in the first arm.

9. The locking tool of claim 1 wherein a third stop on the link engages the second lobe to temporarily hold the catch when the catch is rotated in the second direction under the force exerted by the spring.

10. The locking tool of claim 9 wherein the first stop, the second stop, and the third stop are engaged sequentially by the catch.

11. The locking tool of claim 1 wherein the second lobe engages the second stop on the link to hold the catch in the intermediate position and the first lobe engages the first stop on the link to lock the second jaw in the locked position when the second lobe is disengaged from the second stop by movement of the first arm away from the second arm.

12. A locking tool comprising:

a first arm supporting a first jaw;

a second arm movable relative to the first arm between a first position and a second position;

a second jaw movable between a locked position when the second arm is in the first position and an unlocked position when the second arm is in the second position;

a link comprising a first stop and a second stop, the link being operatively connected to the first arm and to the second arm such that the link moves as the second arm moves between the first position and the second position;

a locking mechanism for locking the second jaw in the locked position the locking mechanism comprising a catch pivotably mounted relative to the second arm and having a first lobe and a second lobe extending from the catch that are positioned to engage the link, the link moving the catch from a rest position toward an intermediate position as the second arm moves between the second position and the first position by a first movement of the second arm toward the first arm, the second lobe engaging the second stop on the link to hold the catch in the intermediate position and the first lobe engaging the first stop on the link to lock the second jaw in the locked position when the second lobe is disengaged from the second stop by movement of the second arm away from the first arm; and the first lobe being configured to disengage from the first stop to unlock the second jaw by a second movement of the second arm toward the first arm.

13. The locking tool of claim 12 wherein the link comprises a first end pivotably connected to the second arm and a second end pivotably connected to a movable collar on the first arm where the collar can move along the first arm.

14. The locking tool of claim 12 wherein the catch is pivotably mounted on the second arm.

15. The locking tool of claim 12 wherein a spring biases the catch in a direction away from the intermediate position.

16. The locking tool of claim 12 further comprising a safety for preventing the catch from rotating when the pliers are in the locked position.

17. The locking tool of claim 12 wherein the link further comprises a third stop that is engaged by the second lobe when the when the second lobe is disengaged from the second stop by movement of the first arm away from the second arm.

18. The locking tool of claim 17 wherein the second lobe is disengaged from the third stop by movement of the first arm away from the second arm.

19. A method of operating a locking tool comprising:

operating a first arm and a second arm to move the first arm and the second arm relative to one another to move a first jaw relative to a second jaw;

moving the first arm and the second arm toward one another to operate a locking mechanism comprising a link, the link comprising a first stop and a second stop and being operatively connected to the first arm and to the second arm such that the link moves as the first arm and the second arm move toward one another and a catch pivotably mounted relative to the second arm and having a first lobe and a second lobe extending from the catch that are positioned to engage the link such that the link moves the catch from a rest position toward an intermediate position such that the second lobe engages the second stop on the link to hold the catch in the intermediate position and allowing the second arm to move away from the first arm such that the first lobe engages the first stop on the link when the second lobe is disengaged from the second stop to lock the jaws relative to one another; and moving the first arm and the second arm toward one another to disengage the first lobe from the first stop and to unlock the jaws relative to one another.

20. The method of claim 19 further comprising engaging a safety to prevent the jaws from unlocking.

* * * * *